US008991956B2

(12) United States Patent
Arakane

(10) Patent No.: US 8,991,956 B2
(45) Date of Patent: Mar. 31, 2015

(54) INK JET RECORDING DEVICE

(71) Applicant: Satoru Arakane, Nagoya (JP)

(72) Inventor: Satoru Arakane, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/848,702

(22) Filed: Mar. 21, 2013

(65) Prior Publication Data

US 2013/0286067 A1 Oct. 31, 2013

(30) Foreign Application Priority Data

Mar. 30, 2012 (JP) ..... 2012-079813

(51) Int. Cl.

| | |
|---|---|
| ***B41J 29/38*** | (2006.01) |
| ***B41J 23/00*** | (2006.01) |
| ***B41J 2/045*** | (2006.01) |
| ***B41J 19/14*** | (2006.01) |
| ***B41J 19/20*** | (2006.01) |

(52) U.S. Cl.

CPC ..... *B41J 2/04541* (2013.01); *B41J 19/142* (2013.01); *B41J 19/207* (2013.01)

USPC ..... 347/9; 347/14; 347/37

(58) Field of Classification Search

CPC . B41J 2/04501; B41J 2/04503; B41J 2/04541

USPC ..... 347/5, 9–14

See application file for complete search history.

(56) References Cited

U.S. PATENT DOCUMENTS

| | | | | |
|---|---|---|---|---|
| 6,877,837 | B1 | 4/2005 | Igarashi et al. | |
| 2005/0146555 | A1 | 7/2005 | Igarashi et al. | |
| 2009/0214228 | A1 * | 8/2009 | Ito | 399/21 |
| 2010/0123751 | A1 * | 5/2010 | Iesaki | 347/16 |
| 2011/0069102 | A1 * | 3/2011 | Horade et al. | 347/16 |
| 2011/0122188 | A1 * | 5/2011 | Mitsunaga | 347/16 |
| 2011/0310168 | A1 * | 12/2011 | Numata | 347/29 |

FOREIGN PATENT DOCUMENTS

| | | | |
|---|---|---|---|
| JP | 2001-169584 | A | 6/2001 |
| JP | 2002-178587 | A | 6/2002 |
| JP | 2003-191560 | A | 7/2003 |
| JP | 2003191560 | A * | 7/2003 |
| JP | 2006-247919 | A | 9/2006 |

OTHER PUBLICATIONS

Takahashi, Machine Translation of JP 2003191560 A.*

* cited by examiner

*Primary Examiner* — Geoffrey Mruk
*Assistant Examiner* — Scott A Richmond
(74) *Attorney, Agent, or Firm* — Baker Botts L.L.P.

(57) ABSTRACT

An ink jet recording device includes a conveying unit, carriage, motor, recording head, encoder, and controller. The controller is configured to perform: a recording control for controlling the recording head to eject ink while the carriage is moving; and a first movement control for setting a target stand-by position from which the carriage is configured to start moving in a particular direction and controlling the motor to move the carriage to and stop at the target stand-by position. Further, the controller is configured to control the carriage to move in the particular direction, when the carriage stops at a position upstream of the target stand-by position in the particular direction in the first movement control, from the upstream position at which the carriage has stopped, and to perform the recording control during a period of continuous movement of the carriage across the target stand-by position.

15 Claims, 17 Drawing Sheets

INK JET RECORDING DEVICE

CROSS-REFERENCE TO RELATED APPLICATION

This application claims priority from Japanese Patent Application No. 2012-079813, filed on Mar. 30, 2012, the disclosure of which is incorporated herein by reference.

BACKGROUND OF THE INVENTION

1. Field of the invention

The disclosure relates generally to an ink jet recording device in which a recording head mounted on a carriage records an image on a sheet while the carriage is made to reciprocate.

2. Description of Related Art

A known ink jet recording device records an image on a sheet with a recording head being made to reciprocate along the sheet. The recording head is mounted on a carriage. The carriage is made to reciprocate by a driving force transmitted from a motor, in a direction intersecting the direction in which the sheet is conveyed. The recording head ejects ink while the carriage is reciprocating, to thereby record an image on the sheet.

SUMMARY OF THE INVENTION

Aspects of the disclosure provide an ink jet recording device capable of moving the carriage in a shorter time.

According to an embodiment of the disclosure, an ink jet recording device comprises a conveyor configured to convey a recording medium in a conveying direction; a carriage configured to reciprocate along a moving direction intersecting the conveying direction; a motor configured to drive the carriage; a recording head mounted on the carriage and configured to eject ink onto the recording medium; an encoder configured to generate a signal corresponding to movement of the carriage; and a controller configured to control a movement of the recording head and the motor according to the signal from the encoder. The controller is configured to perform: a recording control configured to control the recording head to eject the ink while the carriage is moving; and a first movement control configured to set a target stand-by position from which the carriage is configured to start moving in a particular direction and to control the motor to move the carriage to and stop at the target stand-by position. The controller is configured to control the carriage to move in the particular direction, when the carriage stops at a position upstream of the target stand-by position. In the particular direction in the first movement control, from the upstream position at which the carriage has stopped, and to perform the recording control during a period of continuous movement of the carriage across the target stand-by position.

According to an embodiment of the disclosure, a computer-readable storage medium stores computer-readable instructions that, when executed by a processor, cause a method to be performed, comprising: moving a recording head mounted on a carriage according to a signal from an encoder; ejecting ink from the recording head while the carriage is moving; and setting a target stand-by position from which the carriage is configured to start moving in a particular direction and moving the carriage to and stopping at the target stand-by position. Further, when the carriage stops at a position upstream of the target stand-by position in the particular direction, the carriage is moved in the particular direction from the upstream position at which the carriage has stopped, and ink is ejected from the recording head while the carriage is moving during a period of continuous movement of the carriage across the target stand-by position.

BRIEF DESCRIPTION OF THE DRAWINGS

For a more complete understanding of the present disclosure, needs satisfied thereby, and the objects, features, and advantages thereof, reference now is made to the following descriptions taken in connection with the accompanying drawings.

FIG. 4A depicting the carriage opposing a platen, FIG. 4B depicting the carriage positioned at a target stand-by position, and FIGS. 4C and 4D depicting the carriage deviated from the target stand-by position to the left and the right, respectively.

FIG. 5A depicting the image recording being performed on a recording region, FIG. 5B depicting the carriage positioned at a target standby position to perform image recording on another recording region, and FIG. 5C depicting the carriage made to move to another recording start position.

FIGS. 8A and 8B depicting the carriage deviated from the target stand-by position to the left and the right, respectively, and FIG. 8C depicting the carriage deviated to the right from the target stand-by position and frameless recording being performed on a recording region margin.

DETAILED DESCRIPTION OF EMBODIMENTS OF THE INVENTION

Figure 1:
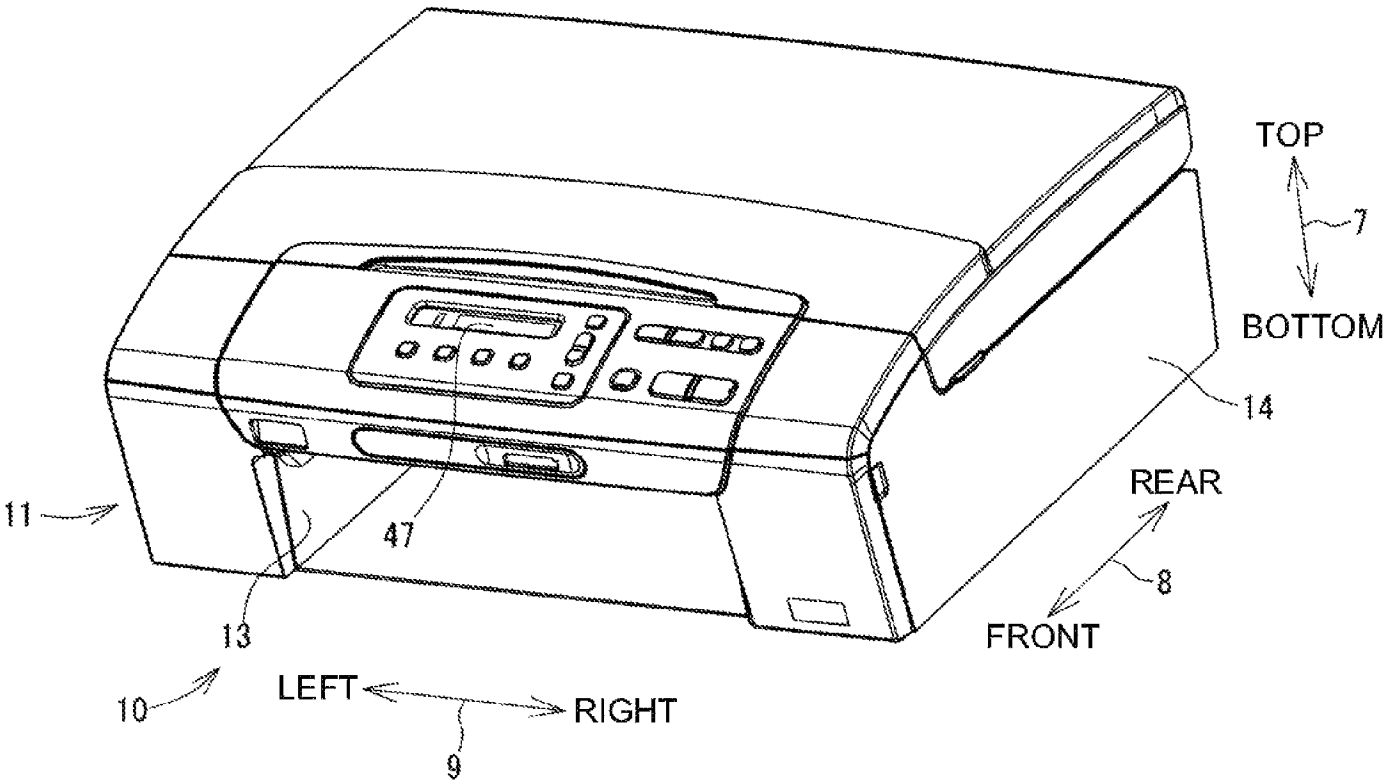
FIG. 1 is a perspective view depicting a multi-function device according to an embodiment of the disclosure.

Example embodiments are described in detail herein with reference to the accompanying drawings, like reference numerals being used for like corresponding parts in the various drawings. It is a matter of course that the following embodiment is merely exemplary, and may be modified in various manners within the scope of the disclosure.

Image recording may be performed by repeating a plurality of passes. The pass may include a series of actions from the start of the movement of the carriage to the ejecting of the ink from the recording head while the carriage is moving. To perform high-quality image recording, the carriage may be accelerated to a predetermined speed, from a target stand-by position, before the recording head may start ejecting the ink.

When moved to the target stand-by position, from which the carriage is to start moving, the carriage may be stopped at a position deviated from the target stand-by position, depending on the inertia or load exerted to the carriage or due to an error of motor current. With material degradation of the parts of the recording device over time, the deviation between the target stand-by position and the position where the carriage is actually stopped may increase. In addition, when the carriage is again made to move to the target stand-by position, it may take a longer time before the carriage reaches the correct position, which may lead to an increase in total time necessary for the image recording. Accordingly, certain aspects of the disclosure have been developed in view of the problems described above as well as other problems, A multi-function device 10 may be placed as depicted in FIG. 1 when in use. In this embodiment, three directions: top-bottom direction 7, front-rear direction 8, and left-right direction 9 are defined as indicated by arrows in FIG. 1. In the subsequent description, the top-bottom direction 7 may be described on the basis of the state where the multi-function device 10 is usably placed (see FIG. 1) as reference; the front-rear direction 8 may be described on the basis of the position of an opening 13 being the near (front) side; and the left-right direction 9 may be described on the basis of the view of the multi-function device 10 from the near (front) side.

As depicted in FIG. 1, the multi-function device 10, exemplifying the ink jet recording device according to the disclosure, may have a thin, generally rectangular block shape, and may include an ink jet printer unit 11. The multi-function device 10 may have a printing function to record an image on a recording sheet 21 (see FIG. 2), exemplifying the sheet according to the disclosure. The printer unit 11 may include a housing 14 having the opening 13 formed in the front face thereof, and a tray 20 (see FIG. 2) on which recording sheets 21 of different sizes can be placed may be removably inserted through the opening 13. An LCD panel 47 that displays various information for operation may be provided on the front face of the multi-function device 10.

Figure 2:
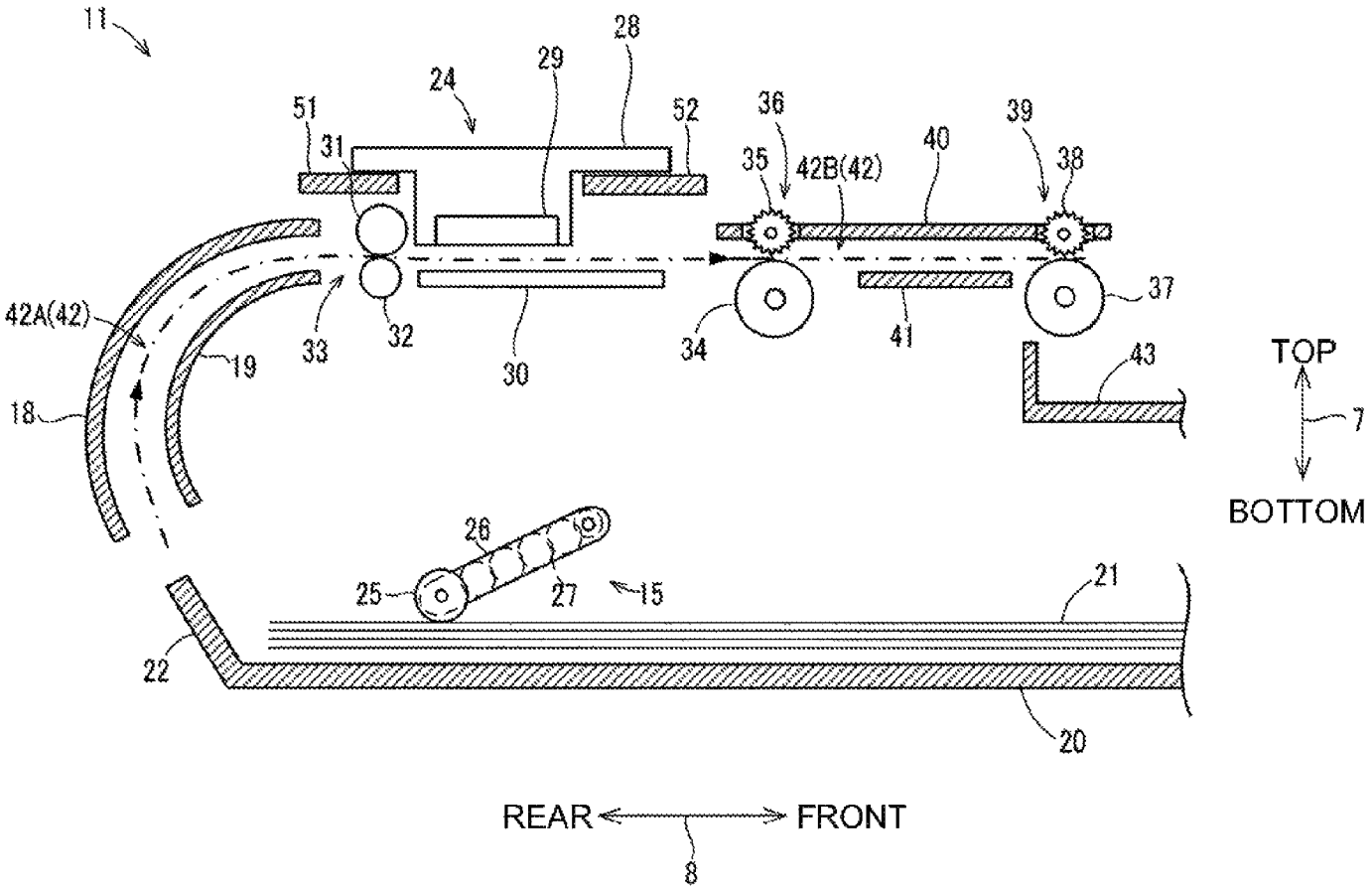
FIG. 2 is a schematic drawing depicting a configuration of a printer unit according to an embodiment of the disclosure.

As depicted in FIG. 2, the printer unit 11 may include a feed unit 15, a recording unit 24, and so forth. The feed unit 15 may pick up the recording sheet 21 from the tray 20 and may supply the recording sheet 21. The recording unit 24 may eject ink droplets onto the recording sheet 21 supplied by the feed unit 15, thereby recording an image on the recording sheet 21.

Figure 3:
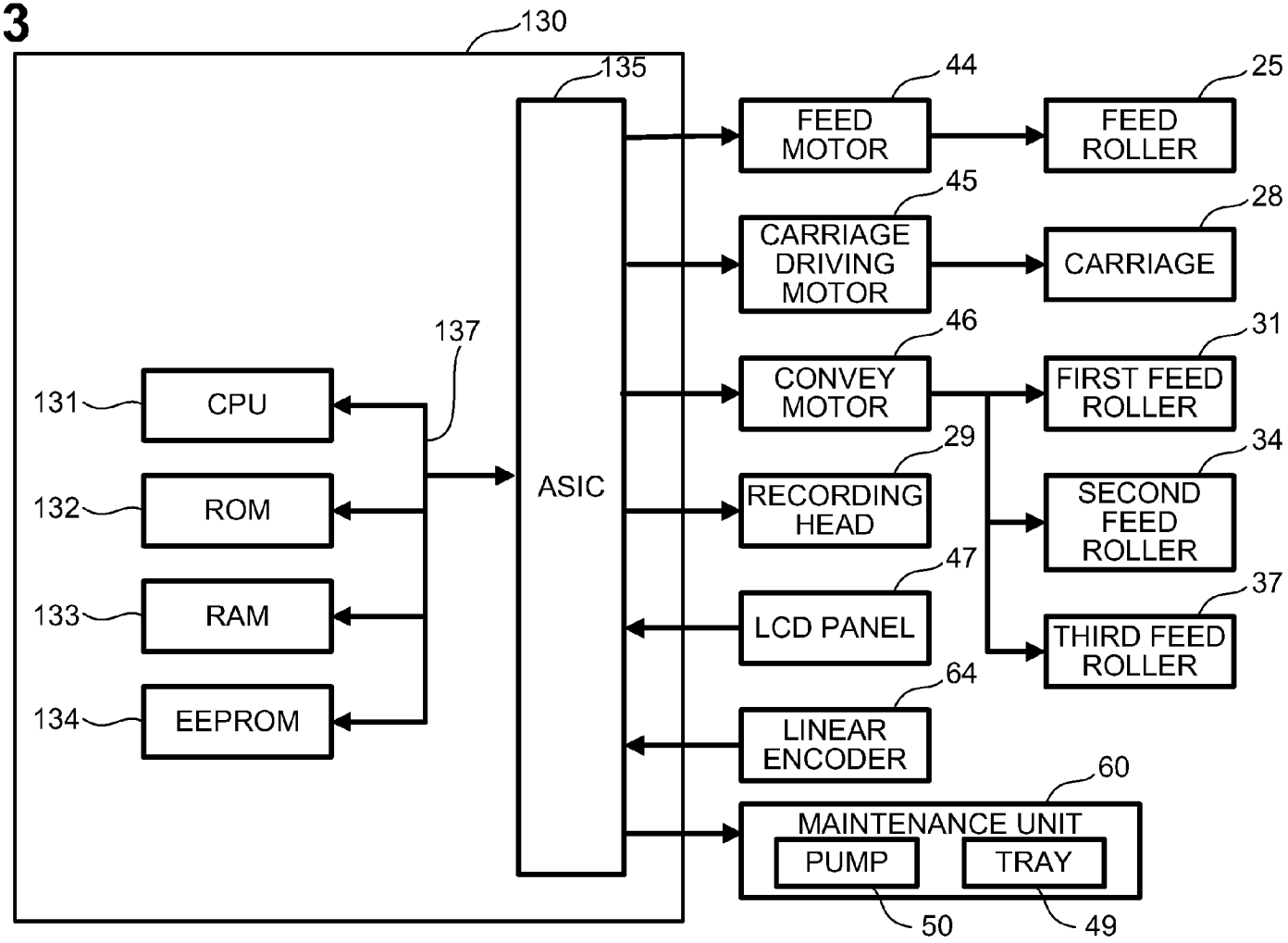
FIG. 3 is a functional block diagram of a control unit according to an embodiment of the disclosure.

As depicted in FIG. 2, the feed unit 15 may include a feed roller 25, a feed arm 26, and a drive transmission mechanism 27. The feed roller 25 may be driven to rotate by driving force of a feed motor 44 (see FIG. 3) transmitted by the drive transmission mechanism 27 composed of a plurality of gears engaged with each other. The drive transmission mechanism 27 may be installed inside the feed arm 26. The feed roller 25 may supply the recording sheet 21 to a curved path 42A, described in more detail below.

As depicted in FIG. 2, the printer unit 11 may include therein a conveying path 42 formed from the leading end of the tray 20 (rear end) to a discharged sheet holder 43 through the recording unit 24. The conveying path 42 may be sectioned into a curved path 42A and a discharge path 42B. The curved path 42A may be the portion between the leading end of the tray 20 and the recording unit 24. The discharge path 42B may be the portion between the recording unit 24 and the discharged sheet holder 43.

The curved path 42A may be a curved passage extending from the vicinity of an inclined portion 22 of the tray 20 to the recording unit 24. The recording sheet 21 supplied from the tray 20 may be bent so as to make a U-turn to the forward direction, guided through the curved path 42A in a conveying direction (direction indicated by an arrow marked on dash-dot lines in FIG. 2). Upon making the U-turn, the recording sheet 21 may be guided to be disposed under the recording unit 24. The curved path 42A may be composed of an outer guide member 18 and an inner guide member 19 opposing each other with a predetermined distance therebetween. The outer guide member 18, the inner guide member 19, and guide members 40 and 41, which are subsequently described, all extend in the left-right direction 9 (depth direction in FIG. 2).

The discharge path 42B may be a linear passage extending from directly below the recording unit 24 to the discharged sheet holder 43. The recording sheet 21 may be moved in the conveying direction along the discharge path 42B. The discharge path 42B may be composed of the recording unit 24 and a platen 30, in the region where the recording unit 24 may be provided, the recording unit 24 and the platen 30 opposing each other with a predetermined distance therebetween. In the remaining region, the discharge path 42B may be composed of an upper guide member 40 and a lower guide member 41 opposing each other with a predetermined distance therebetween.

The recording unit 24 may include a carriage 28 and a recording head 29 mounted on the carriage 28, as depicted in FIG. 2. The carriage 28 may be supported by a first frame 51 and a second frame 52. The first frame 51 and the second frame 52 may he generally of a plate shape having the longitudinal side oriented in the left-right direction 9, and spaced from each other in the front-rear direction 8. The carriage 28 may be made to reciprocate in the left-right direction 9 together with the recording head 29, by a driving force from a carriage driving motor 45 (see FIG. 3) transmitted through a drive transmission mechanism (not depicted), the carriage driving motor 45 exemplifying the motor according to the disclosure. In this operation, the first frame 51 and the second frame 52 may serve as a rail along which the carriage 28 may reciprocate. The left-right direction 9 is an example of the width direction according to the disclosure.

In the recording head 29, a plurality of nozzles may be formed in a lower nozzle surface 53 (see FIGS. 4A to 4D, 5A to 5C, and 8A to 8C) opposing the platen 30. The nozzles each may communicate with an ink cartridge (not depicted) in which one of cyan, magenta, yellow, and black ink may be stored.

The platen 30, which may serve to retain or support the recording sheet 21 in a horizontal position, may be disposed under the recording unit 24 at the position opposing the recording unit 24 across the conveying path 42. While reciprocating in the left-right direction 9, the recording head 29 may eject ink supplied from the ink cartridge onto the recording sheet 21 conveyed over the platen 30. Thus, an image may be recorded on the recording sheet 21 travelling along the conveying path 42.

An ink collection tray 49 (see FIGS. 4A to 4D), exemplifying the tray according to the disclosure, may be provided on the left of the platen 30. The ink collection tray 49 may be disposed so as to oppose the recording unit 24 across the conveying path 42 when the carriage 28 is shifted to the left from the reciprocating range for performing the image recording. At this position, the recording head 29 may be driven to eject air through the nozzle (an example of maintenance control according to the disclosure). Residual waste ink in the nozzle may be discharged together with air and may land on the ink collection tray 49. The waste ink that has landed on the ink collection tray 49 may be sent to a waste ink tank (not depicted). The above operation may be performed for the purpose of nozzle maintenance of the recording head 29, which may be called flushing. The flushing may be performed upon receipt of an instruction from the user, or at a predetermined timing. The ink collection tray 49 and a pump 50, or the like, which causes the recording head 29 to eject air, exemplify a maintenance unit 60 according to the disclosure.

An optical linear encoder 64 (see FIG. 3) exemplifying the encoder according to the disclosure may be provided on the carriage 28 and the second frame 52. The linear encoder 64 may include a slender encoder strip (not depicted) having scales marked thereon in the left-right direction 9, and a reading head (not depicted) that may read the scales on the encoder strip with an optical sensor (not depicted). The encoder strip may be provided on the second frame 52. The reading head may be mounted on the carriage 28, and the optical sensor may be disposed so as to oppose the surface of the encoder strip on which the scales may be marked. The output of the optical sensor may vary as the optical sensor relatively moves with respect to the scales on the encoder strip, with the movement of the carriage 28. The reading head may convert the changes of the output of the optical sensor into pulse signals and may transmit the pulse signals to a control unit 130 (see FIG. 3).

The image recording by the recording unit 24 may be performed by repetitions of a plurality of passes. The pass may include a series of actions from the start of the movement of the carriage 28 to the ejecting of the ink from the recording head 29 while the carriage 28 moves, which may be an example of the recording control according to the disclosure. By performing a pass, an image may be recorded on a region of the recording sheet 21 corresponding to the width of the nozzles aligned in the front-rear direction 8. Upon completing each pass, the recording sheet 21 may be conveyed a predetermined distance by a first roller pair 33, which is subsequently described, and the next pass may be performed. Thus, the image may be sequentially recorded on the recording sheet 21 from a downstream portion in the conveying direction.

The recording unit 24 may selectively perform one of a constant speed recording in which the recording head. 29 may eject the ink onto the recording sheet 21 while the carriage 28 is moving at a constant speed, and an acceleration recording in which the recording head 29 may eject the ink onto the recording sheet 21 while the carriage 28 is accelerating. When the carriage 28 is moving at a speed V1 (e.g., the first speed according to the disclosure), the carriage 28 may be maintained at the constant speed and the constant speed recording may be performed. When the carriage 28 is moving slower than the speed V1, the carriage 28 may be accelerated and the acceleration recording may be performed. In the acceleration recording, the ejecting timing of the ink may be corrected according to the acceleration. The image recording described above may be performed under the control of the control unit 130. The speed V1 may be stored in a ROM 132 (see FIG. 3) of the control unit 130.

The recording unit 24 may be capable of performing the image recording so as to eject the ink onto a position outside of the edge of the recording sheet 21. Accordingly, the recording unit 24 may be capable of performing the image recording without leaving a blank region on the periphery of the recording sheet 21 (hereinafter referred to as frameless recording). The ink that has landed on a position outside of the edge of the recording sheet 21, (i.e., the ink that has landed on the platen 30) may be collected by an ink collection mechanism (not depicted) and sent to a waste ink tank.

As depicted in FIG. 2, the first roller pair 33, including a first convey roller 31 and a pinch roller 32, may be provided upstream of the recording unit 24 in the conveying direction. The pinch roller 32 may be disposed in press-contact with the surface of the first convey roller 31 by an elastic member, such as a spring (not depicted). The first roller pair 33 may pinch the recording sheet 21 fed through the curved path 42A and may convey the recording sheet 21 to the platen 30.

A second roller pair 36, including a second convey roller 34 and a spur 35, may be provided downstream of the platen 30 in the conveying direction. The spur 35 may be disposed. In press-contact with the surface of the second convey roller 34 by an elastic member, such as a spring (not depicted). The second roller pair 36 may pinch the recording sheet 21 having the image recorded by the recording unit 24 and may convey the recording sheet 21 to the downstream side in the conveying direction.

A third roller pair 39, including a third convey roller 37 and a spur 38, may be provided downstream of the second roller pair 36 in the conveying direction. The spur 38 may be disposed in press-contact with the surface of the third convey roller 37 by an elastic member, such as a spring (not depicted). The third roller pair 39 may pinch the recording sheet 21 conveyed by the second roller pair 36 and may convey the recording sheet 21 toward the discharged sheet holder 43.

The first convey roller 31, the second convey roller 34, and the third convey roller 37 may be made to rotate by driving force of a convey motor 46 (see FIG. 3) transmitted by a drive transmission mechanism (not depicted). The aforementioned roller pairs may exemplify the conveyor according to the disclosure.

The control unit 130 may control the overall operation of the multi-function device 1. The control unit 130 may be realized as a microcomputer and may include a CPU 131, a ROM 132, a RAM 133, an EEPROM 134, and an ASIC 135, which may be connected via an internal bus 137.

The ROM 132 may contain a program to be performed by the CPU 131 to execute various operations including the recording control of the multi-function device 1. The RAM 133 may serve as a storage region utilized by the CPU 131 to temporarily store data and signals to be used when executing the program, or as an operating region for data processing. The EEPROM 134 may store settings and flags to be maintained after power may be turned off.

The feed motor 44, the carriage driving motor 45, the convey motor 46, the recording head 29, the LCD panel 47, and the linear encoder 64 may be electrically connected to the ASIC 135. The ASIC 135 may be incorporated with a driver circuit that may control the respective motors.

The ASIC 135 also may receive the pulse signal outputted from the linear encoder 64. The control unit 130 may calculate the travel distance and the position of the carriage 28 on the basis of the pulse signal from the linear encoder 64, and may cause the carriage driving motor 45 to rotate such that the calculated travel distance and the position correspond to a target travel distance and a target position.

When the carriage 28 is made to move, the control unit 130 may set a target stand-by position at which the carriage 28 is to be stopped. The control unit 130 may control the rotation of the carriage driving motor 45 so that the carriage 28 stops at the target stand-by position. The target stand-by position for the flushing and image recording process are described in more detail below. In the following description, the position of the carriage 28 may be defined with reference to the right end of the nozzle surface 53. Target stand-by positions P1 and P2, a recording start position P3, and a landing limit position P4 depicted in FIGS. 4A to 4D, 5A to 5C, and 8A to 8C also may be expressed as positions based on the right end of the nozzle surface 53. In FIGS. 5A to 5C, and 8A to 8C, the target stand-by position P2, the recording start position P3, and the landing limit position P4 may be defined based on the carriage moving to the right in each pass. The target stand-by position may include a slight spatial margin, and may not necessarily be determined completely free from a predetermined margin of error, such that the target stand-by position may comprise a region.

Figure 4A:
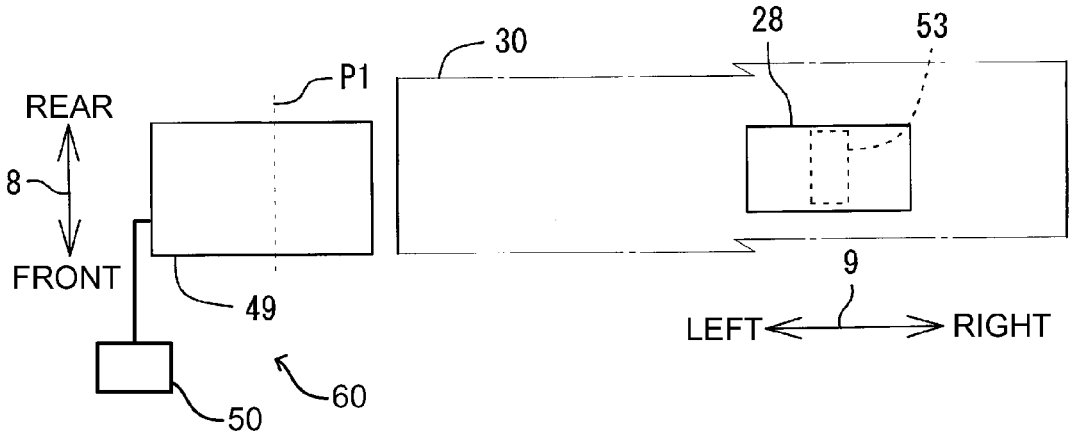
FIGS. 4A to 4D are diagrams depicting movement of a carriage when flushing is performed according to an embodiment of the disclosure.
Figure 4B:
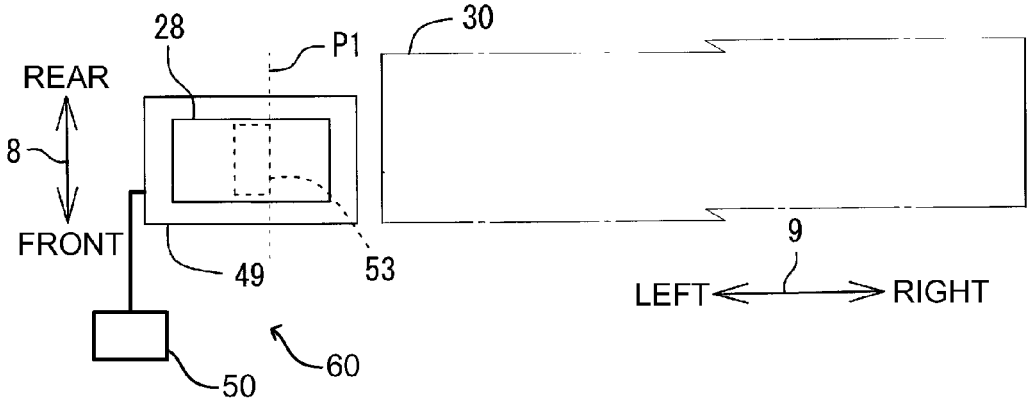

FIGS. 4A to 4D depict the target stand-by position P1 for the flushing process. The target stand-by position P1 may be the position where the carriage 28 may be disposed when air is ejected from the nozzle(s) of the recording head 29. In FIG. 4A, the carriage 28 may be disposed at the position opposing the platen 30. When the condition for performing the flushing is satisfied, the control unit 130 may move the carriage 28 to the left as far as the target stand-by position P1 depicted in FIG. 4B and may stop the carriage 28 at that position. When the carriage 28 is disposed at the position depicted in FIG. 4B, the waste ink ejected from the nozzle(s) of the recording head 29 by the flushing may land on the ink collection tray 49. The control to move the carriage 28 to the target stand-by position P1 may be an example of the second movement control according to the disclosure.

Figure 5A:
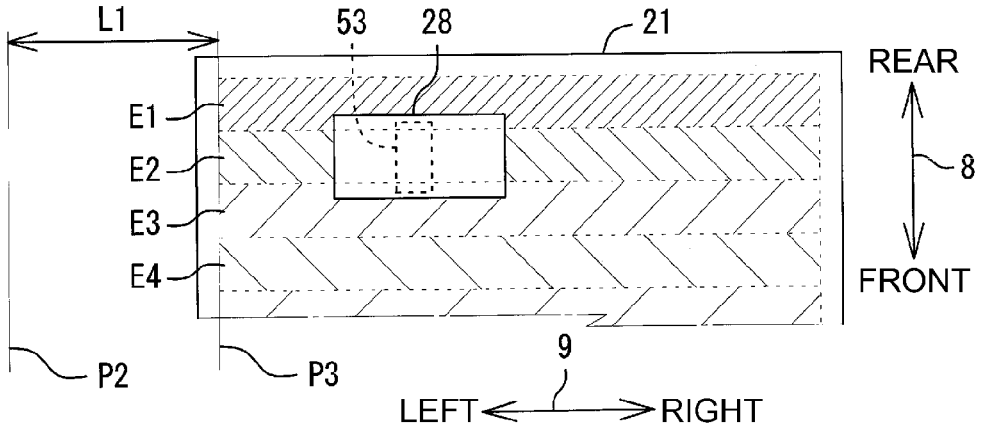
FIGS. 5A to 5C are diagrams for depicting movement of a carriage when image recording is performed according to an embodiment of the disclosure.
Figure 5B:
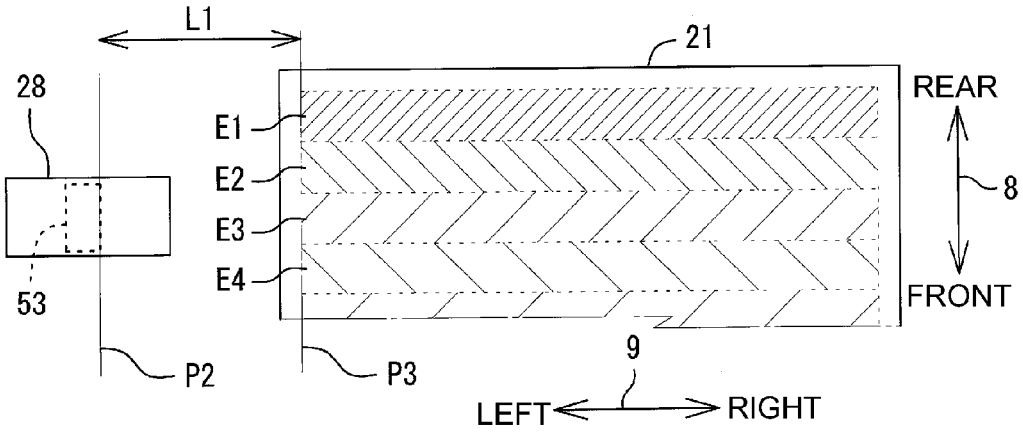
Figure 5C:
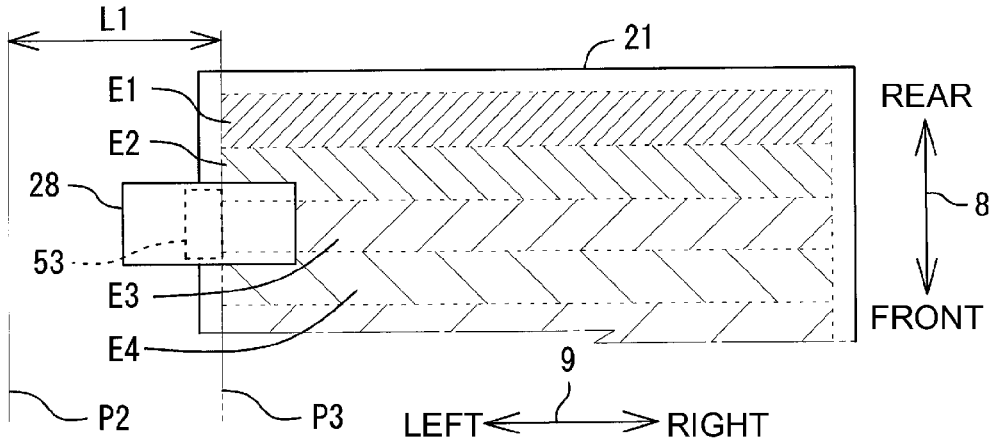

FIGS. 5A to 5C depict the target stand-by position P2 for the image recording process. The target stand-by position P2 may be the position from which the carriage 28 is to start moving, in each pass, to perform the image recording. Accordingly, the target stand-by position P2 may be set for each pass. FIGS. 5A to 5C depict, however, that the target stand-by position P2 may be set, for example, at the same position for all the passes. In FIG. 5A, recording regions E1 to E4 may be specified on the recording sheet 21. The recording regions E1 to E4 may represent the regions on the recording sheet 21 in which the image may be recorded in each pass. FIG. 5A depicts the state in which the carriage 28 may move to the right and the ink may be ejected onto the recording region E2. Upon completing the pass for the recording region E2, the pass for the recording region E3 may be performed. After the pass for the recording region E2 is finished, the control unit 130 may cause the recording sheet 21 to be moved in the conveying direction until the recording region E3 overlaps the carriage 28 in the front-rear direction 8. At the same time, the control unit 130 may move the carriage 28 as far as the target stand-by position P2 depicted in FIG. 5B and may stop the carriage 28 at that position. The control to move the carriage 28 to the target stand-by position P2 may be an example of the first movement control according to the disclosure.

The target stand-by position P2 may be determined on the basis of the recording start position P3 (see FIG. 5C) and a first acceleration distance L1. The recording start position P3 may be the position at which the carriage 28 may be disposed when the recording head 29 starts ejecting the ink. Accordingly, the ink ejected when the carriage 28 is at the recording start position P3 may land on the left end of the recording region of the current pass. The first acceleration distance L1 may be the minimum distance necessary for the carriage 28 to reach the speed V1 after starting the acceleration, As depicted in FIGS. 5B and 5C, the target stand-by position P2 may be spaced to the left of the recording start position P3 by the first acceleration distance L1 Therefore, when the carriage 28 has started moving from the target stand-by position P2, the carriage speed is increased to the speed V1 before reaching the recording start position P3. Thus, when the carriage 28 starts moving from the target stand-by position P2, the constant speed recording may be performed from the recording start position P3.

The movement control for the carriage 28 in the flushing and image recording process now will be described in more detail, with reference to the flowcharts depicted in FIGS. 6, 7, 9, and 10.

Figure 6:
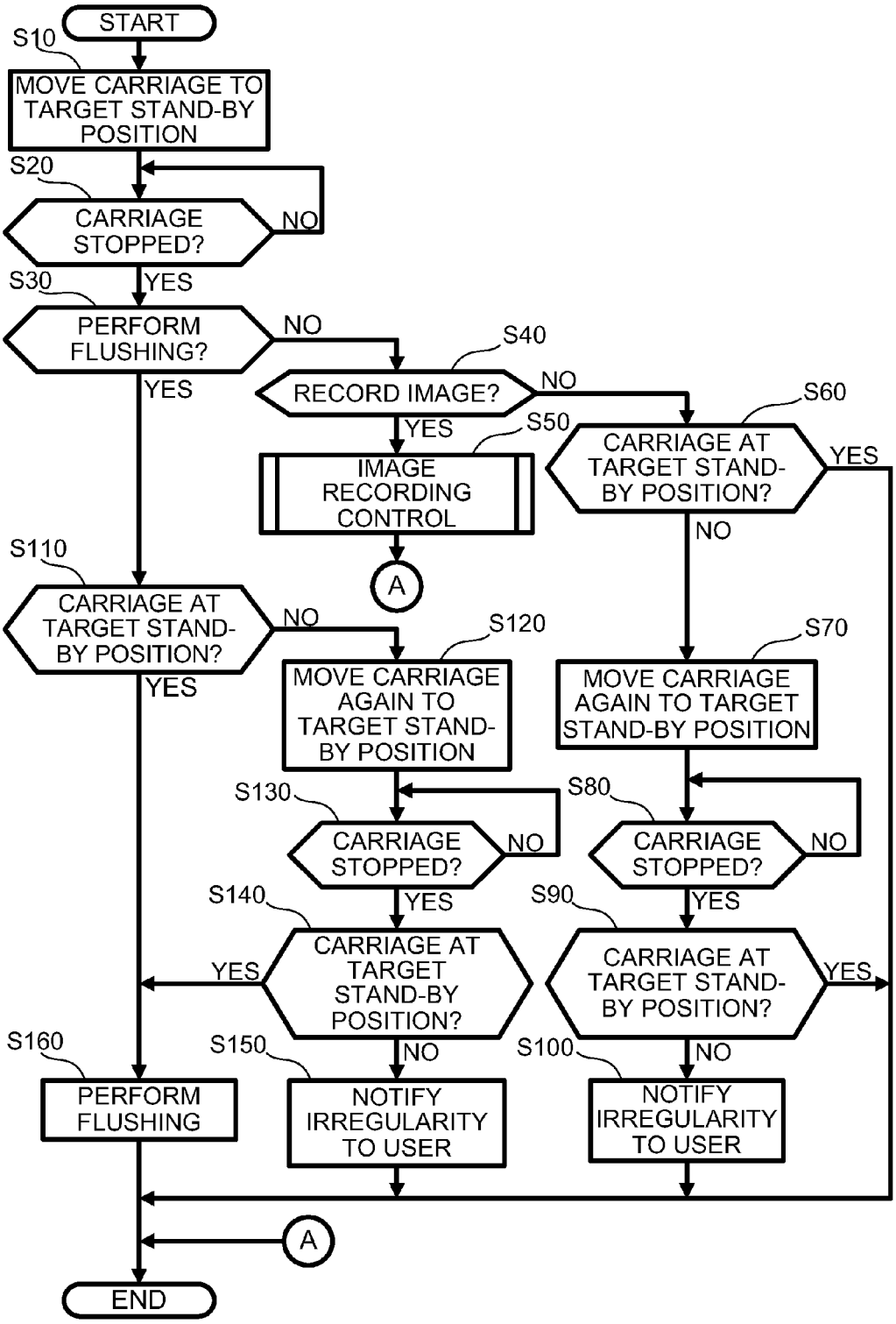
FIG. 6 is a flowchart representing a movement control process for the carriage performed by the control unit according to an embodiment of the disclosure.

FIG. 6 depicts the control process performed by the control unit 130 to move the carriage 28. When the flushing or the image recording is performed, or when a predetermined condition is satisfied, the control unit 130 may set the target stand-by position. At S110, the control unit 130 may control the carriage driving motor 45 so as to move the carriage 28 to the target stand-by position and to stop the carriage 28 at that position. For example, the control unit 130 may check the signal from the linear encoder 64 while the carriage 28 is moving, and may determine whether to stop the rotation of the carriage driving motor 45 at a predetermined time interval. Upon stopping the rotation of the carriage driving motor 45, the control unit 130 may confirm that the carriage 28 has stopped according to the signal from the linear encoder 64 (e.g., Yes at S20).

When the movement at S10 is for the flushing process (e.g., Yes at S30), i.e., when the target stand-by position at S10 is the target stand-by position P1 depicted in FIGS. 4A to 4D, the control unit 130 may determine whether the carriage 28 has stopped at the target stand-by position P1. This determination may be made according to whether a difference between the number of pulses outputted by the linear encoder 64 and the number of pulses that are supposed to be received when the carriage 28 accurately stops at the target stand-by position P1 is within a predetermined threshold range.

Figure 4C:
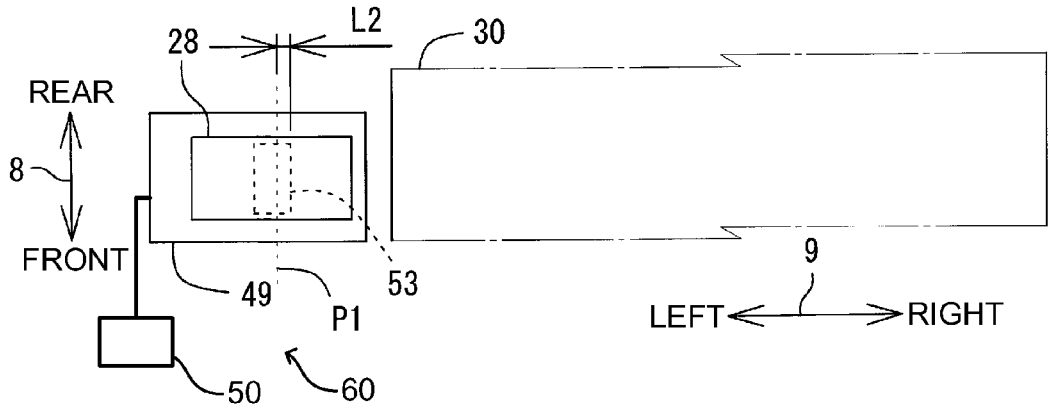
Figure 4D:
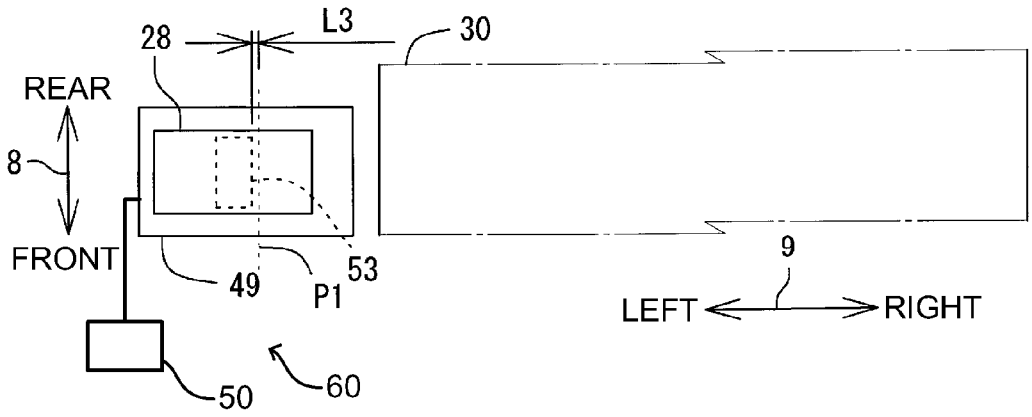

For example, in FIG. 4C, the carriage 28 may be shifted to the right by a distance L2 from the target stand-by position P1 in FIG. 4D, the carriage 28 may be shifted to the left by a distance L3 from the target stand-by position P1. When the threshold Lb utilized at S110 is, for example, expressed as L3<Lb<L2, it may be determined that the carriage 28 has stopped at the target stand-by position in FIG. 4D, and it may be determined that the carriage 28 has not stopped at the target stand-by position in FIG. 4C.

When the carriage 28 is determined to have stopped at the target stand-by position P1 (e.g., Yes at S110), the flushing may be performed at S160. When the carriage 28 is determined not to have stopped at the target stand-by position P1 (e.g., No at S110), the control to move the carriage 28 to the target stand-by position P1 may be performed again at S120. The control unit 130 may stop the rotation of the carriage driving motor 45 at a predetermined timing in the same manner as at S20, and then may confirm that the carriage 28 has stopped according to the signal from the linear encoder 64 (e.g., Yes at S130). The control unit 130 may again determine whether the carriage 28 has stopped at the target stand-by position P1, and when the carriage 28 is determined to have stopped at the target stand-by position P1 (e.g., Yes at S140), the flushing may be performed at S160. When it is determined that the carriage 28 has not stopped at the target stand-by position P1 (e.g., No at S140), the carriage 28 has failed twice successively to stop at the target stand-by position. In this case, it may be presumed that the recording sheet 21 jammed in the conveying path 42 is impeding the movement of the carriage 28. The control unit 130 may discontinue movement control of the carriage 28, and may output an error message to be displayed on the LCD panel 47, or on the display of a computer connected to the multi-function device 10 at S150, When the movement at S10 is for the image recording process (e.g., Yes at S40), i.e., when the target stand-by position at S10 is the target stand-by position P2 depicted in FIGS. 5A to 5C, the image recording control may be performed at S50. The image recording control will be described in more detail below. When the movement at S10 is performed for a purpose other than the flushing and the image recording (e.g., No at S40), the control unit 130 may determine whether the carriage 28 has stopped at the target stand-by position. When the carriage 28 is determined to have stopped at the target stand-by position (e.g., Yes at S60), the carriage 28 may be made to stop moving. When the carriage 28 is determined not to have stopped at the target stand-by position (e.g., No at S60), the carriage 28 again may be moved to the target stand-by position at S70. After the carriage 28 stops (e.g., Yes at S80), the control unit 130 again may determine whether the carriage 28 has stopped at the target stand-by position at S90. When the carriage 28 is determined to have stopped at the target stand-by position (e.g., Yes at S90), the control unit 130 may stop moving the carriage 28, and when the carriage 28 is determined not to have stopped at the target stand-by position (e.g., No at S90), the control unit 130 may output an error message to be displayed on the LCD panel 47 or on the display of a computer connected to the multi-function device 10 at S100.

Figure 7:
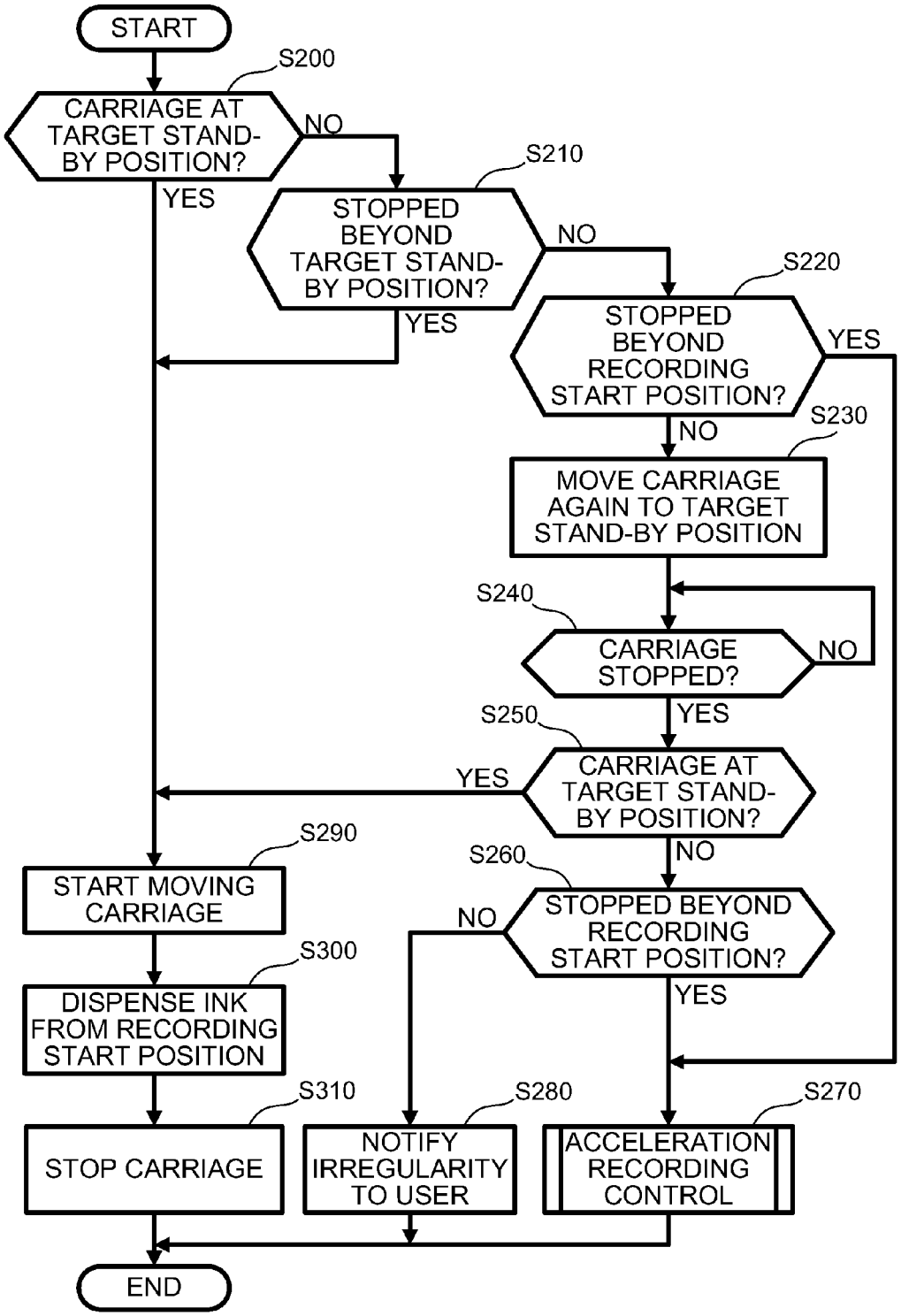
FIG. 7 is a flowchart representing an image recording control process performed by the control unit according to an embodiment of the disclosure.
Figure 8A:
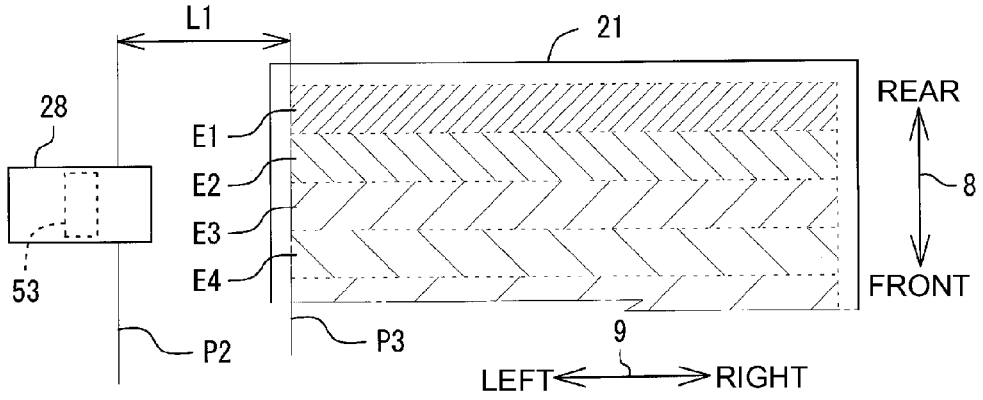
FIGS. 8A to 8C are diagrams for depicting movement of the carriage when image recording is performed according to an embodiment of the disclosure.
Figure 8B:
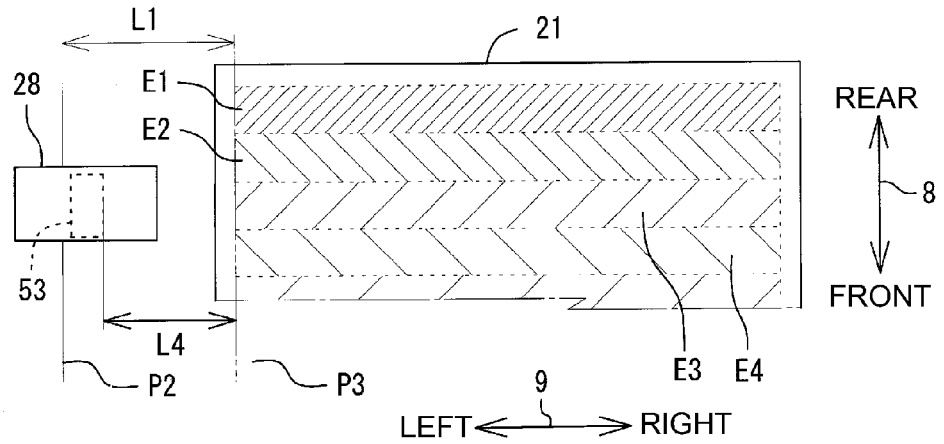
Figure 8C:
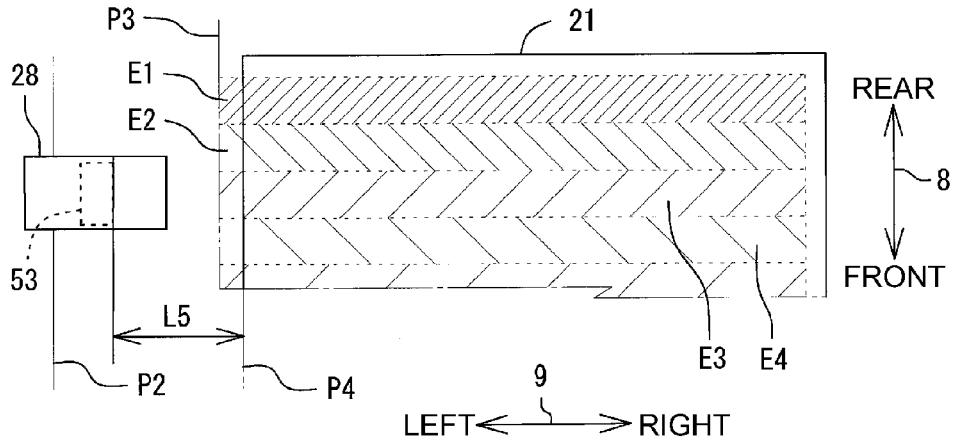

FIG. 7 is a flowchart depicting a control process for the image recording. This flowchart corresponds to S50 in FIG. 6. In the same manner as described above, the control unit 130 may determine whether the carriage 28 has stopped at the target stand-by position P2. When the carriage 28 is determined to have stopped at the target stand-by position P2 (e.g., Yes at S200), the control unit 130 may cause the carriage 28 to start moving from the current position at step S290. When it is determined that the carriage 28 has not stopped at the target stand-by position P2, but at a position beyond the target stand-by position P2, upstream thereof (see FIG. 8A) in the moving direction in the image recording process (i.e., to the right in FIGS. 5A to 5C; hereinafter referred to as recording direction) (e.g., Yes at S210), the control unit 130 may cause the carriage 28 to move, at S290, from that position without stopping the carriage 28 at the target stand-by position P2. The control unit 130 then may cause the recording head 29 to eject the ink at S300. Since the speed of the carriage 28 has reached the speed V1 upon reaching the recording start position P3, the constant speed recording may be performed. At S310, the control unit 130 may stop the carriage 28 at a predetermined position (e.g., a new target stand-by position for the next pass) downstream in the recording direction from the position where the recording head 29 finishes ejecting the ink.

When the carriage 28 is determined to have stopped at a position downstream of the target stand-by position P2 (see FIG. 8B) in the recording direction (e.g., No at S210), the control unit 130 may determine whether the carriage 28 has stopped at a position beyond the recording start position P3, upstream thereof in the recording direction. When the carriage 28 is determined to have stopped at the position upstream of the recording start position P3 (see FIG. 8B) in the recording direction (e.g., Yes at S220), the acceleration recording control may be performed. The acceleration recording control will be described in more detail below. When the carriage 28 is determined to have stopped at a position downstream of the recording start position P3 in the recording direction (e.g., No at S220), the image recording may not be able to be performed unless the carriage 28 is moved again, because the carriage 28 may be downstream of the recording start position P3 in the recording direction. The control unit 130 again may move the carriage 28 to the target stand-by position P2 at S230, and may confirm that the carriage 28 has stopped (e.g., Yes at S240). When the carriage 28 is determined to have stopped at the target stand-by position at this point (e.g., Yes at S250), the carriage 28 may be made to move in the recording direction and the recording head 29 may be caused to eject the ink, in the same manner as above in S290 to S310. In this case, since the speed of the carriage 28 has reached the speed V1 upon reaching the recording start position P3, the constant speed recording may be performed.

Figure 9:
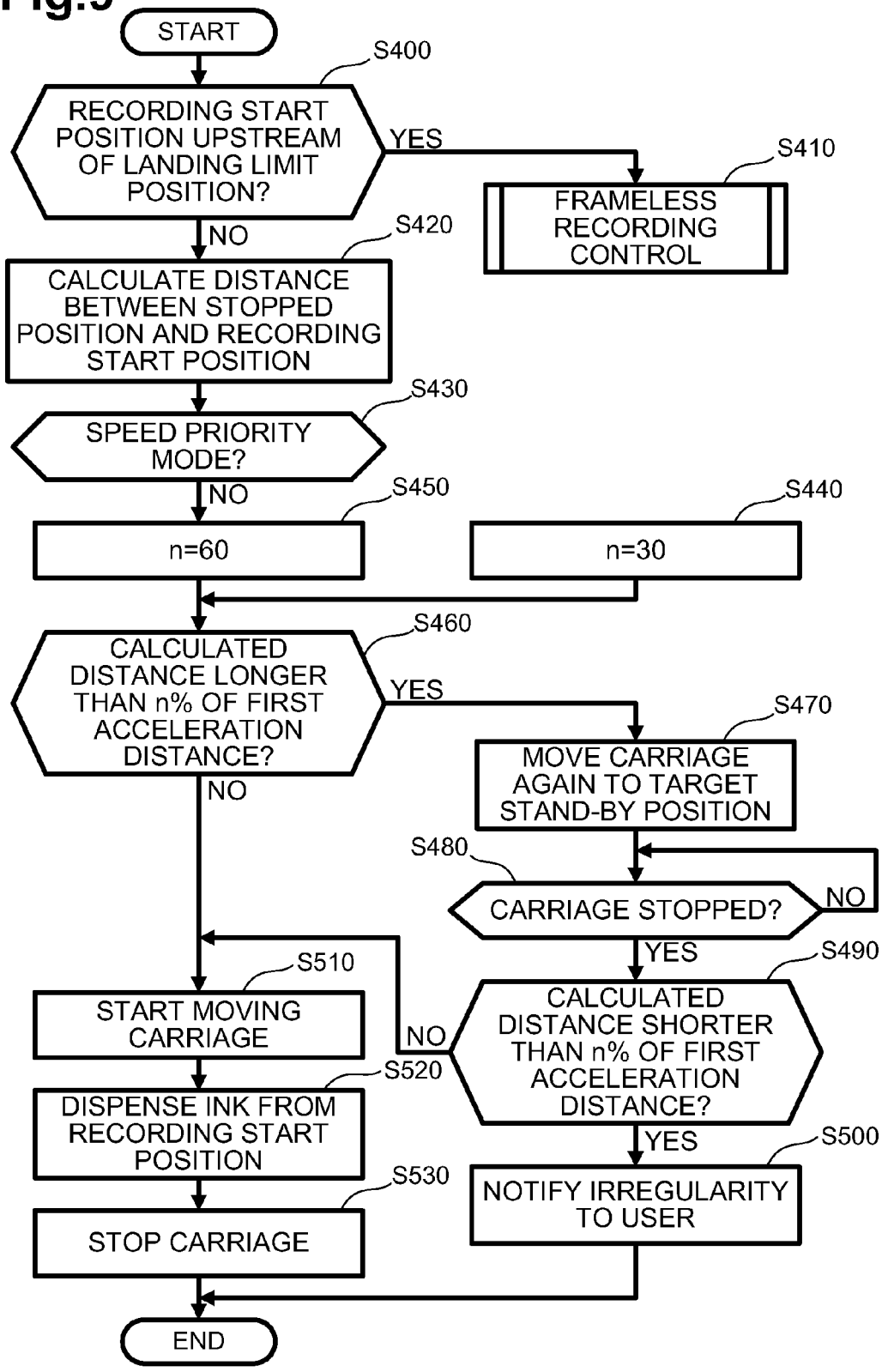
FIG. 9 is a flowchart representing a control process performed by the control for acceleration recording according to an embodiment of the disclosure.

When the carriage 28 is determined not to have stopped at the target stand-by position (e.g., No at S250), the control unit 130 may determine whether the carriage 28 has stopped at a position upstream of the recording start position P3 in the recording direction. When the carriage 28 is determined to have stopped at the position upstream of the recording start position P3 in the recording direction (e.g., Yes at S260), the acceleration recording control may be performed at S270. When the carriage 28 is determined to have stopped at a position downstream of the recording start position 93 in the recording direction (e.g., No at S260), the carriage 28 has stopped twice successively at the position downstream of the recording start position P3 in the recording direction. At S280, the control unit 130 may discontinue movement control of the carriage 28, and may output an error message to be displayed on the LCD panel 47, or on the display of a computer connected to the multi-function device 10, FIG. 9 is a flowchart depicting a control process for the acceleration recording. This flowchart corresponds to S270 in FIG. 7. The control unit 130 may determine whether the recording start position P3 is upstream of the landing limit position P4 (see FIG. 8C) in the recording direction. The landing limit position P4 may be the boundary between whether or not the ejected ink lands on the recording sheet 21. Since the position of the carriage 28 may be defined on the basis of the right end of the nozzle surface 53, the landing limit position P4 may correspond to the left edge of the recording sheet 21. When the carriage 28 is upstream of the landing limit position P4 in the recording direction (an example of the unrecordable range according to the disclosure), the ejected ink may not land on the recording sheet 21, but may land on the platen 30. When the carriage 28 is downstream of the landing limit position P4 in the recording direction (an example of the recordable range according to the disclosure), the ejected ink may land on the recording sheet 21. Thus, the recording start position P3 being upstream of the landing limit position P4 in the recording direction may allow frameless recording to be performed. Performing frameless recording may depend on the size of the recording sheet 21 in the left-right direction 9. The control unit 130 may determine the position of the landing limit position P4 based on the recording sheet 21.

When the recording start position P3 is upstream of the landing limit position P4 in the recording direction (e.g., Yes at S400), the frameless recording control may be performed at S410. The frameless recording control is described in more detail below. When the recording start position P3 is downstream of the landing limit position P4 in the recording direction (e.g., No at S400), the control unit 130 may calculate the distance L4 (see FIG. 8B) between the position where the carriage 28 has stopped and the recording start position P3, and may store the distance L4 in the RAM 133. The control unit 130 may determine whether the image recording process is in a speed priority mode. The mode of the image recording may be selected between the speed priority mode and a quality priority mode. The selected recording mode may be stored in the EEPROM 134.

When the image recording is set in the speed priority mode (e.g., Yes at S430), the control unit 130 may store a local variable n=30 in the RAM 133. When the mode of the image recording is not the speed priority mode, i.e., the quality priority mode (e.g., No at S430), the control unit 130 may store a local variable n=60 in the RAM 131

The control unit 130 may determine thereafter the distance L4 is less than n % of the first acceleration distance L1. When the distance L4 is greater than n % of the first acceleration distance L1 (e.g., No at S460), the control unit 130 may move the carriage 28 and may perform the image recording at S510, S520, and S530. These operations may be similar S290, S300, and S310 in FIG. 7; however, since the speed of the carriage 28 does not reach the speed V1 before reaching the recording start position P3, the acceleration recording may be performed from the recording start position P3. When the speed of the carriage 28 reaches the speed V1, the control unit 130 may stop the acceleration of the carriage 28. In other words, the mode of the image recording may be switched from the acceleration recording to the constant speed recording. The distance corresponding to n % of the first acceleration distance L1 may be an example of the second acceleration distance according to the disclosure. The second acceleration distance may be changed when the recording mode is switched, and therefore a speed V2 (exemplifying the second speed according to the disclosure), which is the minimum speed that the carriage 28 is given when reaching the recording start position P3, may be changed. The control unit 130 may perform the acceleration recording when the speed of the carriage 28 at the time when the carriage 28 has reached the recording start position P3 is between the speed V2 and the speed V1.

When the distance L4 is less than n % of the first acceleration distance L1 (e.g., Yes at S460), a sufficient acceleration distance required for the current recording mode has not been attained. The control unit 130 again may move the carriage 28 to the target stand-by position P2 at S470. The control unit 130 may confirm that the carriage 28 has stopped (e.g., Yes at S480), after which the control unit 130 again may decide whether the distance L4, based on the newly reached position, is less than n % of the first acceleration distance L1. When the distance LA is greater than n % of the first acceleration distance L1 (e.g., No at S490), the control unit 130 may move the carriage 28 to perform the image recording at S510, S520, and S530. When the distance L4 is less than n % of the first acceleration distance L1 (e.g., Yes at S490), the control unit 130 may discontinue movement control of the carriage 28, and may output an error message to be displayed on the LCD panel 47, or on the display of a computer connected to the multi-function device 10 at S500.

Figure 10:
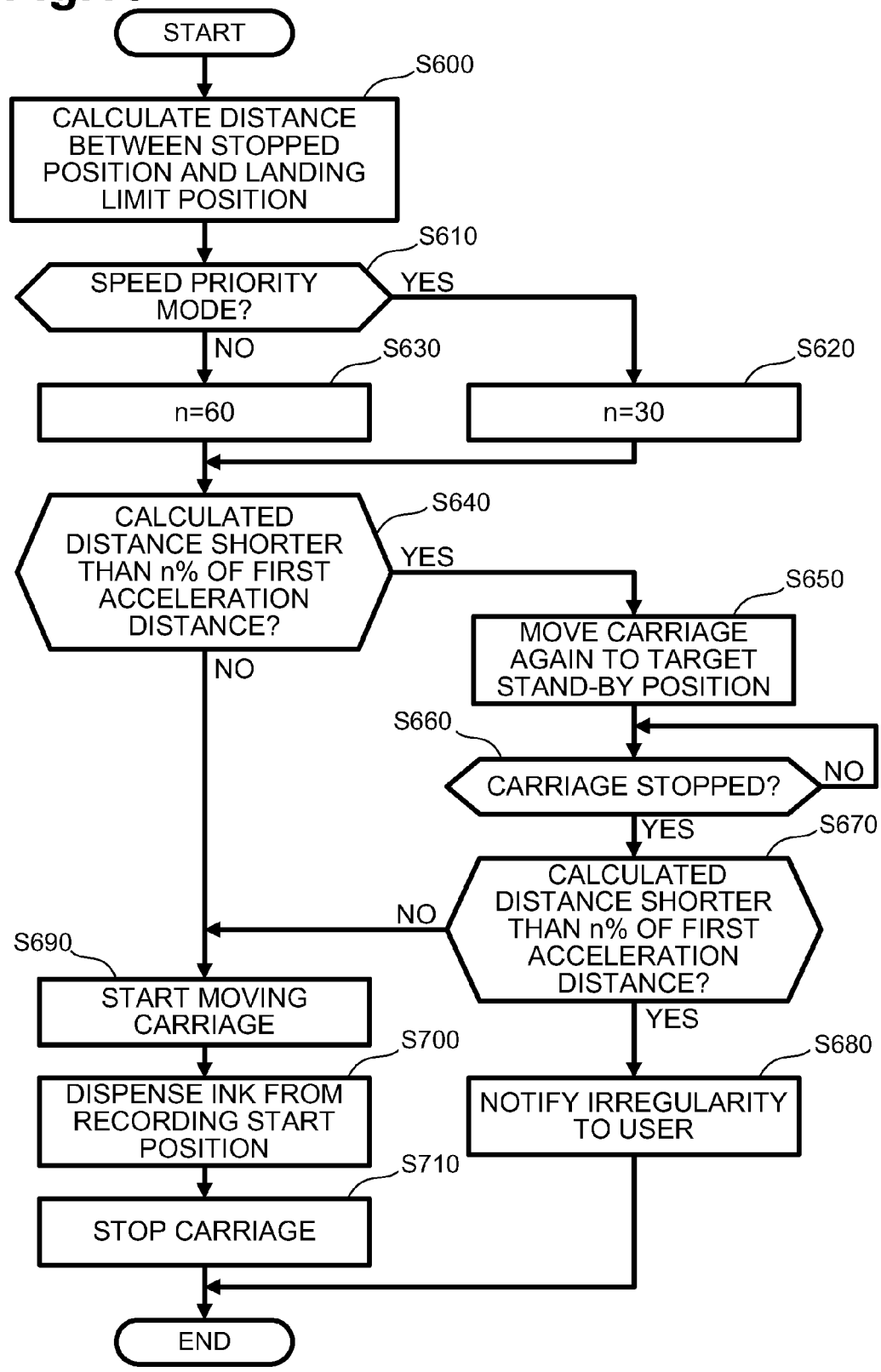
FIG. 10 is a flowchart representing a frameless recording control process performed by the control unit according to an embodiment of the disclosure.

FIG. 10 is a flowchart showing a control process of the frameless recording. This flowchart corresponds to S410 in FIG. 9. The frameless recording control may be similar to the acceleration recording control according to S420 to the end in FIG. 9, and therefore the description of similar processes will not be repeated.

Nevertheless, S420 to the end in FIG. 9 and the process of the frameless recording control may be different in the following manner. The distance L4 between the position where the carriage 28 has stopped and the recording start position P3 may be calculated at S420; however, at S600 of the frameless recording control, a distance L5 (see FIG. 8C) between a the position where the carriage 28 has stopped and the landing limit position P4 may be calculated. At S460 and S490, it may be determined whether the distance L5 is less than n % of the first acceleration distance L1. Similarly, in the frameless recording control, it may be determined whether the image recording is to be performed or the carriage 28 is to be moved again, based on the distance L5. The distance L5 may be used as the reference because, in the frameless recording, the ink ejected before the carriage 28 reaches the landing limit position P4 does not land on the recording sheet 21, and thus, may not affect the quality of the image recording.

In the image recording control, when the carriage 28 stops at a position upstream of the recording target stand-by position P2 in the recording direction, the control unit 130 may move the carriage 28 to perform the image from that position without taking an error into account, which may reduce or eliminate the carriage 28 needing to be moved again to the target stand-by position P2. In addition, when the carriage 28 starts to move from a position upstream of the target stand-by position P2 in the recording direction, the carriage 28 may be accelerated to reach the speed V1 necessary for performing the constant speed recording, before the recording head 29 ejects the ink.

In the acceleration recording control, since the speed of the carriage 28 may reach at least 60% or 30% of the speed V1 before the recording head 29 ejects the ink, the quality of the image recording may be maintained. In addition, the minimum necessary acceleration distance may be determined based upon whether the image recording is performed in the speed priority mode or the quality priority mode. Therefore, a decision may be made as to which of the recording speed or recording quality is more important or desirable.

When performing the acceleration recording, the speed of the carriage 28 may not need to reach the speed V1 necessary for performing the constant speed recording before the carriage 28 reaches the recording start position P3; and therefore, the lower limit of the distance necessary for acceleration may be reduced. Accordingly, it may be even less likely that the carriage 28 needs to be moved again to the target stand-by position P2.

In the frameless recording, the image recording may be performed without leaving a blank space in the margin of the sheet in the left-right direction 9 because the recording start position P3 may be located upstream of the landing limit position P4 in the recording direction. Since the speed of the carriage 28 may reach at least 60% or 30% of the speed V1 before the carriage 28 reaches the landing limit position P4, only the ink ejected thereafter may land on the sheet. Such an arrangement reduces degradation in the quality of the recorded image.

In the frameless recording, since it is sufficient that the speed of the carriage 28 reaches at least 60% or 30% of the speed V1 before the carriage 28 reaches the landing limit position P4, not the recording start position P3, the lower limit of the distance necessary for acceleration may be reduced. Accordingly, it may be even less likely that the carriage 28 needs to be moved again to the target stand-by position P2.

Since it may be determined based upon a threshold whether the carriage 28 is to be moved again to the target stand-by position P1, it may be less likely that the ink ejected for flushing lands outside of the ink collection tray 49.

Further, since an error message may be displayed when the carriage 28 fails again to stop at the designated position, a user may be made aware of the irregularity immediately; and take necessary measures.

In the foregoing embodiments, a purging process or a wiping process may be performed, in addition to the flushing, as part of the maintenance work for the recording head 29. The purging may be an operation of reducing internal pressure in a cap covering the nozzle of the recording head 29, using a pump to thereby suck out the waste ink from the nozzle. The wiping may be an operation of cleaning a region around the nozzle of the recording head 29 with a wiper. To move the recording head 29 to the position where the purging or wiping may be performed, the same control as in the flushing process may be performed.

The variable, n, to be applied to the first acceleration distance L1, determined according to the recording mode in the acceleration recording control or the frameless recording control, may be different from the aforementioned values, or may be adjusted in finer increments. Alternatively, the value of n may be fixed for example at 80, regardless of the recording mode. In this case, the distance corresponding to 80% of the first acceleration distance L1 may be attained for the recording head 29 to be accelerated, Alternatively, the value of n may be fixed at 100. In this case, at least the first acceleration distance L1 may be attained for the recording head 29 to be accelerated. In other words, since the carriage 28 may be accelerated at least to the speed V1 before reaching the recording start position P3 (or landing limit position P4 in the frameless recording control), the constant speed recording may always be performed. Further, when fixing the value of n, the processes of S430 to S450 and S610 to S630 may be skipped. In other words, the control unit 130 may control the speed of the carriage 28 to constantly exceed the speed V1 whenever the carriage 28 reaches the recording start position P3, thereby solely performing the constant speed recording. Alternatively, the recording device may accept a setting of the mode, whether the mode of exclusively performing the constant speed recording or the mode of performing one of the constant speed recording and the acceleration recording depending on the condition.

Further, the carriage 28 may be made to move to the target stand-by position a desired number of times. For example, the error message may be displayed when the carriage 28 fails to stop at the target stand-by position three times.

While the invention has been described in connection with various exemplary structures and illustrative embodiments of the invention, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and described examples are considered as merely illustrative and exemplary of embodiments of the invention, with the true scope of the invention being defined by the following claims.

What is claimed is:

1. An ink jet recording device comprising:

a conveyor configured to convey a recording medium in a conveying direction;

a carriage configured to reciprocate along a moving direction intersecting the conveying direction;

a motor configured to drive the carriage;

a recording head mounted on the carriage and configured to eject ink onto the recording medium;

an encoder configured to generate a signal corresponding to movement of the carriage; and a controller configured to control a movement of the recording head and the motor according to the signal from the encoder, wherein the controller is configured to perform:

a recording control in which the controller is configured to control the recording head to eject the ink while the carriage is moving;

a first movement control in which the controller is configured to set a target stand-by position from which the carriage is configured to start moving in a particular direction and to control the motor to move the carriage to and stop at the target stand-by position;

a first determination control in which the controller is configured to determine that the carriage has stopped at the target stand-by position as part of the first movement control; and a second determination control in which the controller is configured to determine that the carriage has stopped at a position beyond the target stand-by position in an opposite direction, which is opposite to the particular direction, as part of the first movement control, wherein the controller is configured to control the carriage to move in the particular direction after the first movement control, wherein, when the controller determines, in the first determination control, that the carriage has stopped at the target stand-by position as part of the first movement control, the controller controls the motor to move the carriage, which is stopped at the target stand-by position, and performs the recording control, and wherein, when the controller determines, in the second determination control, that the carriage has stopped beyond the target stand-by position in the opposite direction as part of the first movement control, the controller controls the motor to move the carriage, which is stopped at the position beyond the target stand-by position in the opposite direction, and performs the recording control without stopping the carriage as the carriage crosses the target stand-by position while moving in the particular direction.

2. The ink jet recording device according to claim 1, wherein, when the speed of the carriage reaches a predetermined first speed in the recording control, the controller is configured to maintain the speed of the carriage at the first speed and to cause the recording head to eject the ink, and the target stand-by position is determined based on a recording start position at which the recording head is configured to start ejecting the ink and a first acceleration distance, the first acceleration distance being a distance over which the carriage accelerates to the first speed from a stopped position.

3. The inkjet recording device according to claim 2, wherein when the carriage stops between the target stand-by position and the recording start position, the controller is configured to: (i) cause the carriage to move from the position at which the carriage has stopped to perform the recording control, when a distance between the position at which the carriage has stopped and a recordable position is greater than or equal to the first acceleration distance, and (ii) perform the first movement control again when the distance between the position at which the carriage has stopped and the recordable position is less than the first acceleration distance, the recordable position being an upstream edge of the recording medium in the particular direction.

4. The inkjet recording device according to claim 2, wherein the controller is configured to control the recording head to eject the ink while the carriage is accelerating, when the speed of the carriage is greater than or equal to a predetermined second speed and less than the first speed in the recording control, and when the carriage stops between the target stand-by position and the recording start position in the first movement control, the controller is configured to: (i) control the carriage to move from the position at which the carriage has stopped to perform the recording control, when a distance between the position at which the carriage has stopped and the recording start position is greater than or equal to a second acceleration distance, and (ii) perform the first movement control when the distance between the position at which the carriage has stopped and the recording start position is less than the second acceleration distance, the second acceleration distance being a distance over which the carriage accelerates to the second speed from a stopped position.

5. The inkjet recording device according to claim 4, wherein when the carriage stops between the target stand-by position and the recording start position, and the recording start position is in an unrecordable range in the first movement control, the controller is configured to (i) control the carriage to move from the position at which the carriage has stopped to perform the recording control, when a distance between the position at which the carriage has stopped and a recordable position is greater than or equal to the second acceleration distance, and (ii) perform the first movement control when the distance between the position at which the carriage has stopped and the recordable position is less than the second acceleration distance, the unrecordable range being a position range of the carriage in which the ejected ink lands on a position outside of the recording medium in the moving direction, and the recordable position being an upstream edge of the recording medium in the particular direction.

6. The inkjet recording device according to claim 4, further comprising an input unit configured to receive an input, wherein the second speed is changeable according to the input received by the input unit.

7. The inkjet recording device according to claim 1, further comprising a maintenance unit configured to perform maintenance for the recording head, wherein the controller is configured to perform:

a maintenance control configured to cause the maintenance unit to perform the maintenance for the recording head, and a second movement control configured to set a position at which the maintenance control is to be performed as the target stand-by position, and to control the motor to move the carriage to and stop at the target stand-by position; and when, in the second movement control, the carriage stops at a position deviated from the target stand-by position by a distance greater than or equal to a predetermined threshold in the moving direction, the controller is configured to perform the second movement control again.

8. The ink jet recording device according to claim 7, wherein the maintenance unit comprises:

a pump configured to eject air through a nozzle of the recording head; and a tray configured to receive waste ink from the nozzle.

9. The ink jet recording device according to claim 7, the controller is configured to output an error notice when it is determined either that:

after the second movement control is performed twice, the carriage has stopped at a position deviated from the target stand-by position by a distance greater than or equal to the predetermined threshold in the moving direction; or after the first movement control is performed twice, the distance between the position at which the carriage has stopped and a recording start position is less than a particular acceleration distance, the particular acceleration distance being a distance over which the carriage accelerates, from a stopped position, to a predetermined speed for recording.

10. The ink jet recording device according to claim 1, wherein the controller is further configured to reset an encoder value associated with the target stand-by position when the carriage stops at the position beyond the target stand-by position in the opposite direction as part of the first movement control.

11. The ink jet recording device according to claim 1, wherein the controller is further configured to change an encoder value associated with the target stand-by position when the carriage stops at the position beyond the target stand-by position in the opposite direction as part of the first movement control.

12. The ink jet recording device according to claim 11, wherein the encoder value associated with the target stand-by position is changed to an encoder value associated with a new target stand-by position, the new target stand-by position being disposed beyond the target stand-by position in the opposite direction.

13. The ink jet recording device according to claim 1, wherein the controller is further configured to determine a difference between an encoder value associated with the target stand-by position and an actual encoder value associated with the position at which the carriage has stopped.

14. The inkjet recording device according to claim 1, wherein the opposite direction is a direction away from the conveyor.

15. A computer-readable storage medium storing computer-readable instructions that, when executed by a processing system of an ink jet recording device comprising a conveyor configured to convey a recording medium in a conveying direction, a carriage configured to reciprocate along a moving direction intersecting the conveying direction, a motor configured to drive the carriage, a recording head mounted on the carriage and configured to eject ink onto the recording medium, an encoder configured to generate a signal corresponding to movement of the carriage, and a controller configured to control a movement of the recording head and the motor according to the signal from the encoder, instruct the processing system to perform processes comprising:

a recording control in which the controller controls the recording head to eject the ink while the carriage is moving;

a first movement control in which the controller sets a target stand-by position from which the carriage is to start moving in a particular direction and the controller controls the motor to move the carriage to and stop at the target stand-by position;

a first determination control in which the controller determines that the carriage has stopped at the target stand-by position as part of the first movement control;

a second determination control in which the controller determines that the carriage has stopped at a position beyond the target stand-by position in an opposite direction, which is opposite to the particular direction, as part of the first movement control; and a second movement control in which the controller controls the motor to move the carriage in the particular direction after the first movement control, wherein, when the controller determines, in the first determination control, that the carriage has stopped at the target stand-by position as part of the first movement control, the controller controls the motor to move the carriage, which is stopped at the target stand-by position, and performs the recording control, and wherein, when the controller determines, in the second determination control, that the carriage has stopped beyond the target stand-by position in the opposite direction as part of the first movement control, the controller controls the motor to move the carriage, which is stopped at the position beyond the target stand-by position in the opposite direction, and performs the recording control without stopping the carriage as the carriage crosses the target stand-by position while moving in the particular direction.

* * * * *